US007199693B2

(12) United States Patent
Matsutani et al.

(10) Patent No.: US 7,199,693 B2
(45) Date of Patent: Apr. 3, 2007

(54) CHOKE COIL AND ELECTRONIC DEVICE USING THE SAME

(75) Inventors: Nobuya Matsutani, Katano (JP); Tsunetsugu Imanishi, Hirakata (JP); Hidenori Uematsu, Kadoma (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 101 days.

(21) Appl. No.: 10/756,757

(22) Filed: Jan. 14, 2004

(65) Prior Publication Data

US 2004/0145442 A1 Jul. 29, 2004

(30) Foreign Application Priority Data

Jan. 17, 2003 (JP) ..... 2003-009444

(51) Int. Cl.
*H01F 5/00* (2006.01)
*H01F 27/29* (2006.01)

(52) U.S. Cl. ..... 336/200; 336/192; 336/232

(58) Field of Classification Search ..... 336/200, 336/223, 232, 83
See application file for complete search history.

(56) References Cited

U.S. PATENT DOCUMENTS

| | | | | |
|---|---|---|---|---|
| 6,198,375 | B1 * | 3/2001 | Shafer | 336/225 |
| 6,707,367 | B2 * | 3/2004 | Castaneda et al. | 336/200 |
| 6,791,445 | B2 * | 9/2004 | Shibata et al. | 336/90 |
| 2003/0052767 | A1 * | 3/2003 | Yamanobe et al. | 336/232 |

FOREIGN PATENT DOCUMENTS

| | | | |
|---|---|---|---|
| JP | 0408306570 A | * | 11/1996 |
| JP | 2002-248242 | | 8/2002 |

* cited by examiner

*Primary Examiner*—Anh Mai
(74) *Attorney, Agent, or Firm*—Steptoe & Johnson LLP

(57) ABSTRACT

The choke coil disclosed comprises: coils incorporated with terminals and intermediate taps manufactured of die cut metal plates; and a magnetic powder in which the coils are embedded.

19 Claims, 8 Drawing Sheets

CHOKE COIL AND ELECTRONIC DEVICE USING THE SAME

FIELD OF THE INVENTION

The present invention relates to a choke coil capable of being used in DC/DC converter installed in various kinds of electronic devices and the electronic devices using the same.

BACKGROUND ART

An air-core coil, formed of conductive wires with insulation coating, embedded in a magnetic powder is nominated as a conventional choke coil that has been used until today. (Japanese Patent Unexamined Publication No. 2002-246242 discloses an example in FIG. 12 on page 1). The choke coil has a structure such that metal terminals are coupled at ends of the air-core coil by welding, soldering or bonding with a conductive adhesive.

Along with the recent trends of downsizing and low profiling in electronic equipment, a more downsized and low profile designing is required, and in response to a higher speed and integration in LSI such as CPU or the like, a larger current capacity of several A to several tens A in high frequency range is also required for inductors such as choke coil or the like.

Therefore, an excellent and cheaper inductor is awaited that has lower resistance to suppress the heat generation owing to the downsizing, lower losses in high frequency range and lesser decrease of inductance in larger current range caused by DC superposing.

Along with the trends of downsizing and low profiling in electronic equipment, a variety of power supply circuits have been developed in the field of DC/DC converter.

A circuit system for instance so-called multi-phase system to drive a plurality of DC/DC converters in parallel by phase control, as shown in FIG. 4, can reduce ripple currents and can provide a high frequency large current with high efficiency.

A transformer system, as shown in FIG. 6, connecting an intermediate tap provided in the choke coil to a switching element is said to contribute greatly to the design freedom in electronic devices or voltage conversion efficiency in addition to the above needs.

However, the above mentioned circuit configuration alone is not necessarily enough to realize a large current system in high frequency range but choke coils used in the power supply circuit should preferably be designed to realize downsizing and available for high frequency large current applications.

The structure of above-mentioned conventional choke coil, however, metal terminals and intermediate taps must be coupled afterward, and therefore, can hardly keep the DC resistance in a low level. Additionally, the structure not only needs a large setting space but also considered disadvantageous in production cost in case of employing the multi-phase system, the transformer system being introduced for future or a combination system of the two systems.

SUMMARY OF THE INVENTION

The present invention aims at providing a choke coil comprising: a coil incorporated with terminals and intermediate taps manufactured of die cut metal plates and formed by folding or etching; and a magnetic powder in which the coil is embedded.

DETAILED DESCRIPTION OF THE INVENTION

The structure of the choke coil used in the present invention is described with reference to the drawings.

(Exemplary Embodiment 1)

Figure 1A:
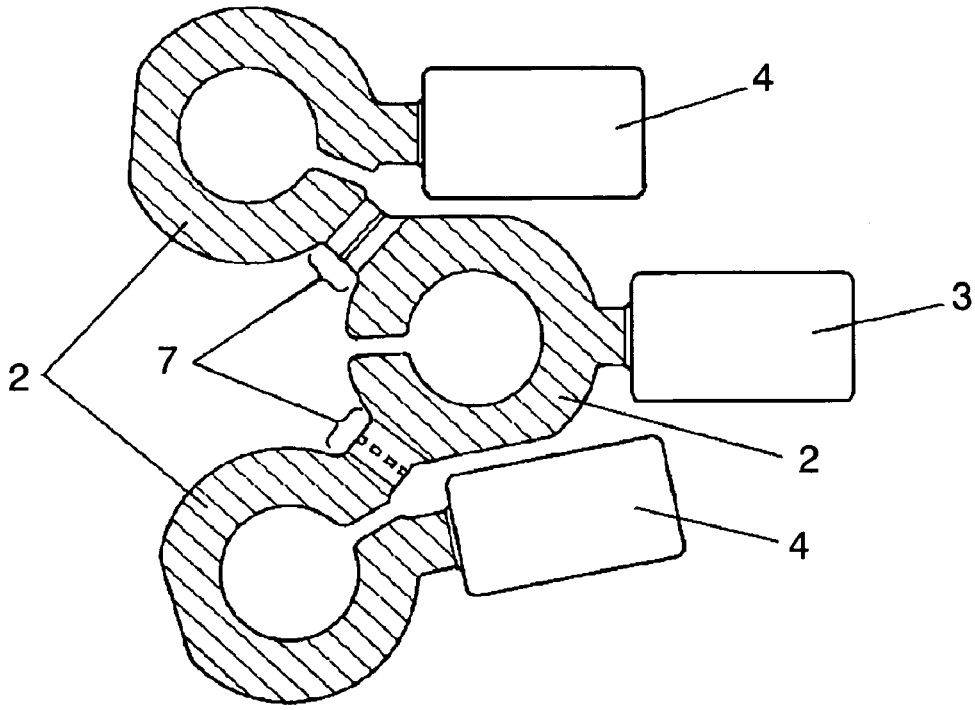
FIG. 1A is a plan view before folding of the coil incorporated with terminals and intermediate tap used in the present invention.
Figure 1B:
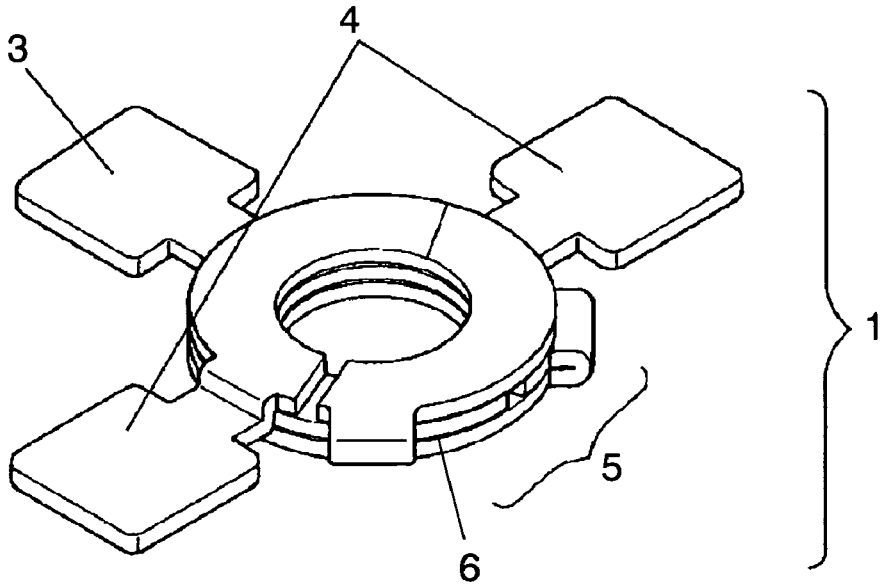
FIG. 1B is a perspective view after folding of the coil incorporated with terminals and intermediate tap used in the present invention.
Figure 2A:
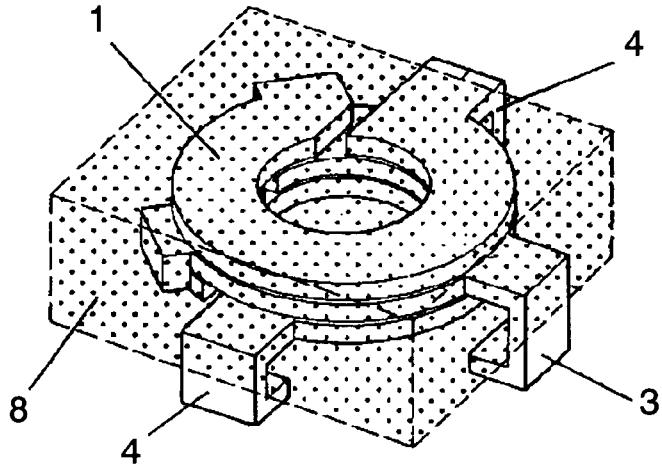
FIG. 2A is a perspective view of the choke coil consisting of the coil incorporated with terminals and intermediate tap used in the present invention.
Figure 2B:
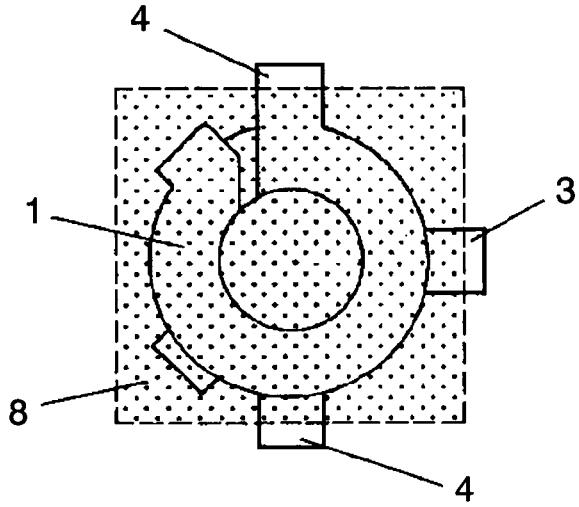
FIG. 2B is a top plan view of the choke coil consisting of the coil incorporated with terminals and intermediate tap used in the present invention.
Figure 2C:
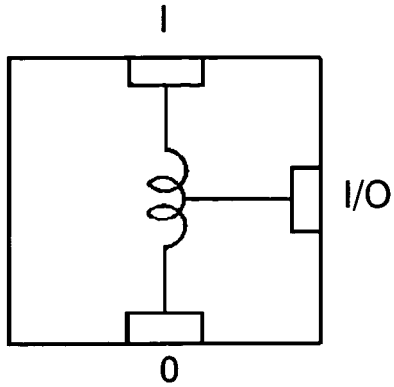
FIG. 2C is a block diagram of the choke coil consisting of the coil incorporated with terminals and intermediate tap used in the present invention.
Figure 4:
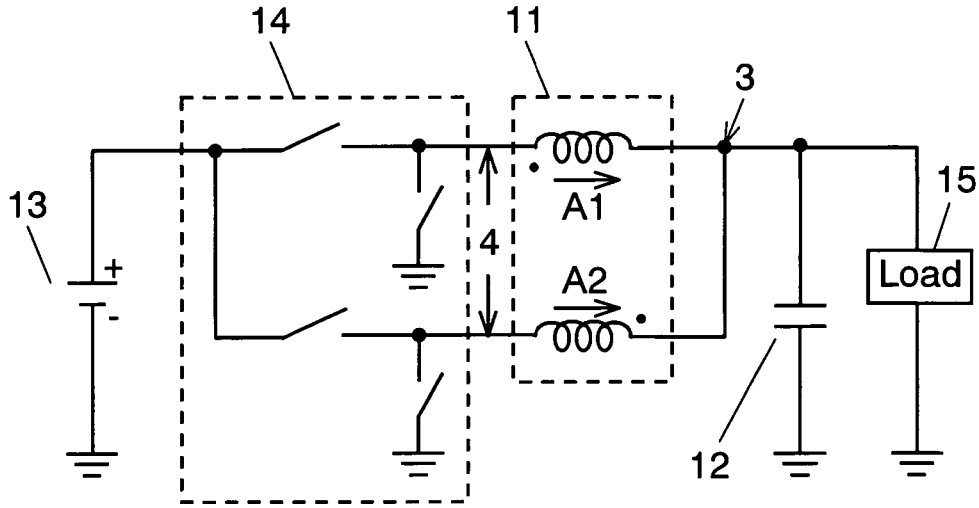
FIG. 4 is a block diagram of the power supply adopting the multi-phase system.

FIG. 1A is a plan view before folding and FIG. 1B is a perspective view after folding respectively of coil 1 incorporated with terminals and intermediate tap used in the present invention. FIGS. 2A, 2B and 2C show the choke coil structure consisting of coil 1, having a winding of 2.5 turns, incorporated with terminals and intermediate tap. FIG. 4 is a block diagram of the power supply adopting the multi-phase system.

Coil 1 incorporated with terminals and intermediate tap comprises: three circular disks 2 ring-shaped by etching or die cutting using metal plate of copper, silver or the like; intermediate tap 3 protruding from one of circular disks 2; and two terminals 4 extending from an end of circular disks 2 as shown in FIG. 1A.

Each circular disk 2 of the die cut metal plate is folded, making to meet each central point, in folds 7 that couple the circular disks. Consequently, a plurality of circular disks 2 forms a structure of coil portion 5 having intermediate tap 3 and two terminals 4 radiated from the center of coil portion 5 to complete coil 1 incorporated with terminals and intermediate tap.

Circular disks 2 forming coil portion 5 are coated with insulation layer 6 to prevent short-circuiting. The layer enables to fold and to lap the circular disks without causing any gap in between resulting a downsized low profile choke coil with a high space factor.

On the other hand, folds 7 are not coated with the insulation layer. This is because the coated insulation layer can possibly be broken owing to the difference of extension and contraction degree upon folding outside and inside in folds 7.

Compared with conventional wire-wound coils, the coil of this invention can be used for large current circuits even in high frequency ranges while the inductance and low DC resistance are maintained because the coil is manufactured of die cut metal plates and formed by folding or etching. Moreover, the coil can keep enough inductance with not so many coil turns resulting a downsized and low profile coil dimensions.

Next, magnetic material 8 is a magnetic material composite composed of soft magnetic alloy powder mixed with 3.3 pts.wt. of silicone resin and sieved by mesh to make a size controlled powder. Soft magnetic alloy powder is produced by water atomization process using the ratio of Fe (50) and Ni (50) having an average grain size of 13 μm.

Additionally, an insulation resin covers respective grains of magnetic metal powder for magnetic material 8 in exemplary embodiment 1. The magnetic metal powder has an excellent saturation flux density, but has a lower resistance as well that causes a large eddy current loss. Therefore, forming a magnetic composite by coating respective grains of the magnetic metal powder with insulation resin to increase the resistance, the problem of eddy current loss is solved and is available for high frequency circuitry.

Moreover, magnetic material 8 can reduce risks of short circuiting and can provide a low profile coil portion 5 with a high space factor because an insulation is applied between a plurality of circular disks 2 that form coil portion 5. Additionally, magnetic material 8 can also reduce short-circuiting with other coils that would be housed in the magnetic material 8 or with other mounted parts.

Especially, an excellent magnetic material can be produced by selecting at least one of Fe, Ni and Co as the main component of the magnetic metal powder. The magnetic material has the characteristics of high saturation flux density and high magnetic permeability, available for large current applications.

Additionally, the composition of the magnetic metal powder should preferably include not less than 90 weight % of Fe, Ni and Co totally. And the average grain size of the magnetic metal powder of 1 to 100 μm is effective to reduce the eddy current loss.

Ferrite or composite material of ferrite powder and insulation resin can provide an effect similar to magnetic material 8. Though having a higher resistance than the magnetic metal powder, the composition can contribute to high frequency applications as the resistance can prevent eddy current from occurring.

The choke coil of the present invention comprises aforementioned coil 1 incorporated with terminals and intermediate tap embedded in the afore-mentioned magnetic material.

Figure 3:
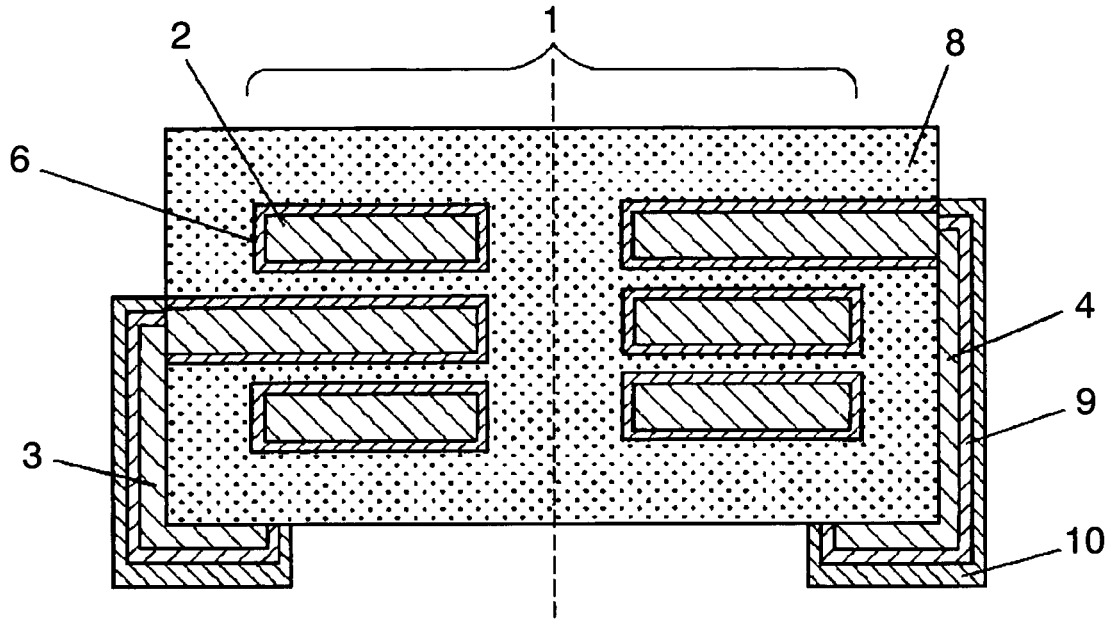
FIG. 3 is a cross-sectional view of the internal structure of the choke coil used in the present invention.

The choke coil is manufactured as follows: firstly aforementioned coil 1 incorporated with terminals and intermediate tap is disposed in a mold as shown in FIG. 3; secondary the coil is covered with the magnetic material except portions of terminals 4 and intermediate tap 3; and then a pressure of 3 ton/cm$^2$ is applied. After taking out of the mold, the coil is heat-treated with a temperature of 150° C. for approx. 1 hour for the hardening of the magnetic material to complete the choke coil.

Terminals 4 and intermediate tap 3 protruding from the magnetic material come out to surfaces of external cover layer and are folded, then foundation layer 9 of Ni is formed on the exposed portions to prevent the metal plate of copper or silver from oxidizing. Additional surface layer 10 of solder, Sn or Pb is formed on foundation layer 9 of Ni to prevent foundation layer 9 from oxidizing and to provide a better solderability.

All of terminals 4 and intermediate tap 3 come out are folded appressed to bottom surface or adjacent surface of the bottom surface of the choke coil. The structure provides the choke coil with smaller dimensions than choke coils having terminals 4 and intermediate tap 3 protruded outside, enabling a higher mounting density.

Aforementioned magnetic material should preferably have square shaping to be sucked reliably in automatic mounting processes. Edge rounding, polygonal or cylindrical shaping is acceptable, provided that the choke coil has a plane top surface to show there a mounting direction or polarity of terminals 4.

In addition, number of turns of coil 1 incorporated with terminals and intermediate tap is not always an integer but can be selected freely like in conventional coils such as 1.5 turns, 1.75 turns. The same is for sizing, inductance, tap positioning or the like.

The choke coil of the present invention comprises the aforementioned structure enabling for use in downsized, high frequency and large current application field. Especially, the choke coil should preferably be used in a power supply circuit composed of a plurality of DC/DC converter connected in parallel as shown in FIG. 4.

FIG. 4 shows a power supply circuit of multi-phase system to form an integration circuit by choke coil 11 and capacitor 12.

Input terminal 13 and switching element 14 are connected to the integration circuit, and load 15 is connected to an output terminal of the power supply circuit.

A case when the choke coil of the present invention is used as a choke coil in a multi-phase system circuit is described. As shown in FIGS. 2A, 2B and 2C, a choke coil with 2.5 turns comprises intermediate tap 3 protruding just in the center of the coil, at the point of 1.25 turns. In other words, the choke coil acts as if two coils work independently via intermediate tap 3 when each of two terminals 4 provided in the coil is connected to switching element 14 of input sides and intermediate tap 3 is connected to output side. In FIG. 4, current A1, and A2 flows from respective terminals 4 to intermediate tap 3. Current A1 and A2 generate magnetic flux passing through both ends of coil 1 incorporated with terminals and intermediate tap to opposite directions each other but flux density in coil 11 is weakened totally. The structure can provide the choke coil with a low DC resistance, smaller setting space and suitable property for use in multi-phase system with a better DC superposing characteristics than two coils having the same number of turns used separately, as the structure can suppress the flux saturation of coil 11.

The choke coil can be used in parallel connection instead of the multi-phase system. For example, a possible case is to use two terminals 4 connected into one as an input side and intermediate tap 3 as an output side. Similarly, the connection can be adopted in a choke coil available for large current applications, because the connection can provide an excellent DC superposing characteristic.

Hereafter, the layout of coils where magnetic fluxes passing through the center of coil weaken each other is called as a negative coupling layout. On the contrary, the positioning of coils where magnetic fluxes passing through the center of coil superpose each other to result a higher inductance is called as a positive coupling layout.

The next example nominates the choke coil used as a transformer in exemplary embodiment 1. Among two terminals 4 of coil 11, one terminal is connected to an input side switching element and the other is connected to an output side. Intermediate tap 3 should be provided in any place required according to the place of input side or output side.

In such a case of application, the choke coil has a high coupling strength and shows a high inductance as the direction of current flow coincides with the direction of magnetic flux. The choke coil can prevent the DC resistance from increasing that contribute to provide a downsized choke coil available for large current applications because different from conventional coils, the terminals need not be coupled in the structure afterward.

The above example nominates an application in which each terminal 4 is used as a separated line, but the choke coil can be of course used as a single coil, or coils in series connection, without using intermediate tap 3.

The choke coil is most suitable for DC/DC converter with small ripple currents and large smoothing effects, because the choke coil is provided with a high inductance like the case used as a transformer.

(Exemplary Embodiment 2)

The choke coil used in exemplary embodiment 2 is described with reference to FIGS. 5A, 5B and 5C. The fundamental structure of coil 1 incorporated with terminals and intermediate tap is similar to the coil used in exemplary embodiment 1, but two coils are embedded in the magnetic material with additional one coil to form a choke coil. Hereafter, the choke coil is called as "double choke coil".

Figure 5A:
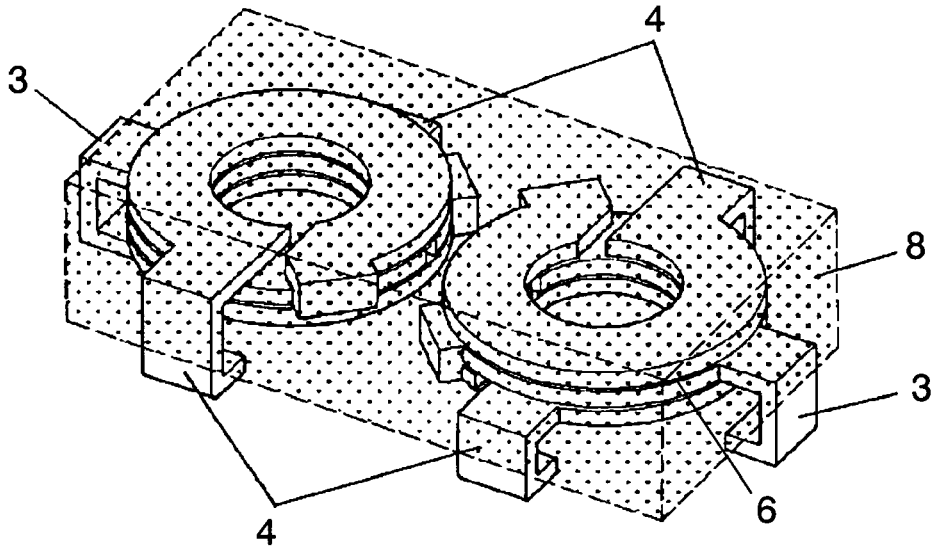
FIG. 5A is a perspective view of the choke coil consisting of the coil incorporated with terminals and intermediate tap used in the present invention.
Figure 5B:
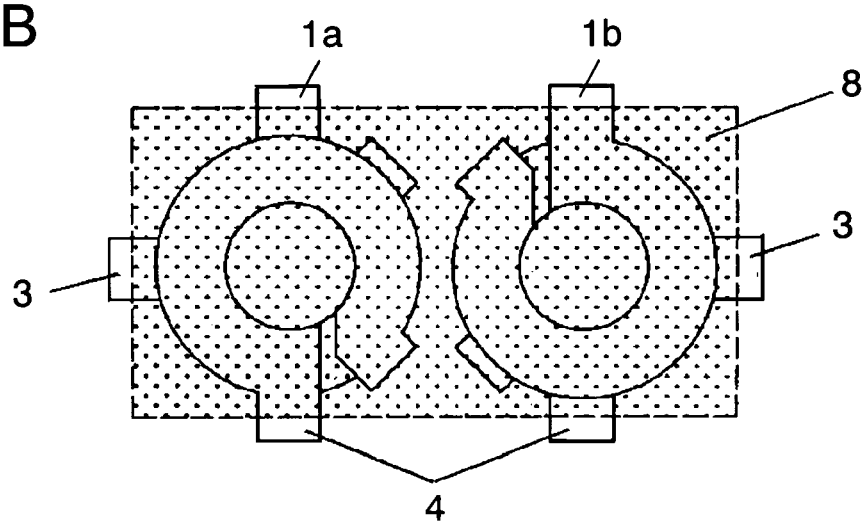
FIG. 5B is a top plan view of the choke coil consisting of the coil incorporated with terminals and intermediate tap used in the present invention.
Figure 5C:
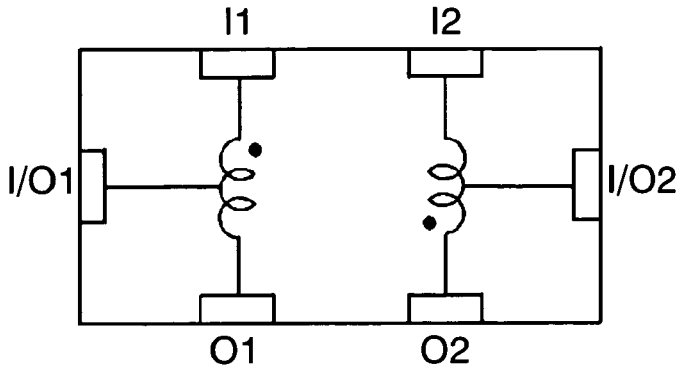
FIG. 5C is a block diagram of the choke coil consisting of the coil incorporated with terminals and intermediate tap used in the present invention.

FIGS. 5A, 5B and 5C show structures of the "double choke coil" with 2.5 turns. Intermediate tap 3 protrudes at the point of 1.25 turns, and two terminals 4 and intermediate tap 3 come out in different surfaces respectively.

Neighboring coils are disposed such that respective magnetic fluxes generated by current flow pass through a center of the coil to opposite directions respectively. FIG. 5A is a perspective view, FIG. 5B is a top plan view and FIG. 5C is an example of a block diagram. I1 and I2 denote input terminals, O1 and O2 denote output terminals, and I/O1 and I/O2 denote intermediate taps connected to switching elements.

Next, how the magnetic field is generated in this structure is described. The magnetic fluxes pass through respective coils in opposite directions. Due to a superposing effect of the magnetic fluxes, a magnetic circuit is formed such that fluxes passing through the center of left hand side coil 1*a* also pass through the center of right hand side coil 1*b* and again return back to the starting coil 1*a*. This can be said a "positive coupling layout" as described in exemplary embodiment 1 and the inductances increase in respective coils 1*a* and 1*b*.

On the contrary, if coils 1*a* and 1*b* are disposed such that respective magnetic fluxes generated by current flow pass through the center of the coil to the same direction respectively, magnetic fluxes of both coils diminish each other in the center of coils 1*a* and 1*b*. In other words, this is a "negative coupling layout", effective to suppress the saturation of magnetic flux. The structure is more suitable for use in large current applications.

In both positive coupling layout and negative coupling layout, adjusting the clearance between coils 1*a* and 1*b* can control the inductances.

A narrower clearance produces a higher inductance in positive coupling layout, but produces a lower inductance in negative coupling layout.

The choke coil has a structure enable to prevent short-circuiting or the like even if the clearance is narrowed, as insulation layer 6 is coated on coil portion 5.

Figure 6:
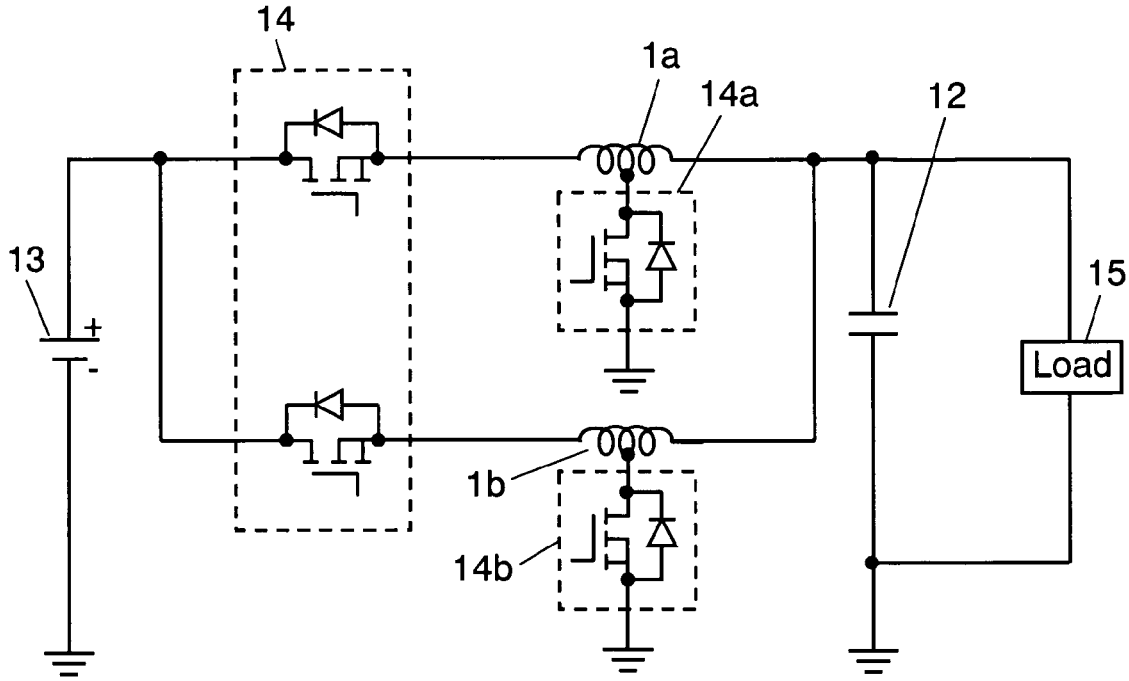
FIG. 6 is a block diagram of the power supply connecting two DC/DC converters in parallel.

Power supply system shown in FIG. 6 can be nominated as an application example of aforementioned double choke coil. In exemplary embodiment 1, the choke coil is described to use as a transformer system or a multi-phase system, A combined use of a transformer system and a multi-phase system becomes possible when the double choke coil is introduced. In FIG. 6, two coils 1*a* and 1*b* embedded in magnetic material are connected in parallel for the phase control, and intermediate tap 3 is connected to switching elements 14*a* and 14*b* respectively, aiming at for use in high frequency applications.

As to the layout for coil 1 incorporated with terminals and intermediate tap used in the circuit system, the clearance and current direction should be determined according to purposes of the choke coil as explained before. Though having such a complicated circuitry, the present invention can realize a downsized low profile choke coil needless to employ a large number of choke coils.

The present invention can provide a choke coil to meet any application purpose as a required inductance can be given by varying clearances between coils embedded or layout combinations of positive/negative coupling.

Double choke coil in exemplary embodiment 2 can be used as a 4-phase DC/DC converter to control 4 phases. Each terminal 4 is connected to input section via each switching element, and intermediate taps 3 are connected all together to the output section. Moreover, many application ways are possible such as series connection or parallel connection as described in exemplary embodiment 1.

Figure 7:
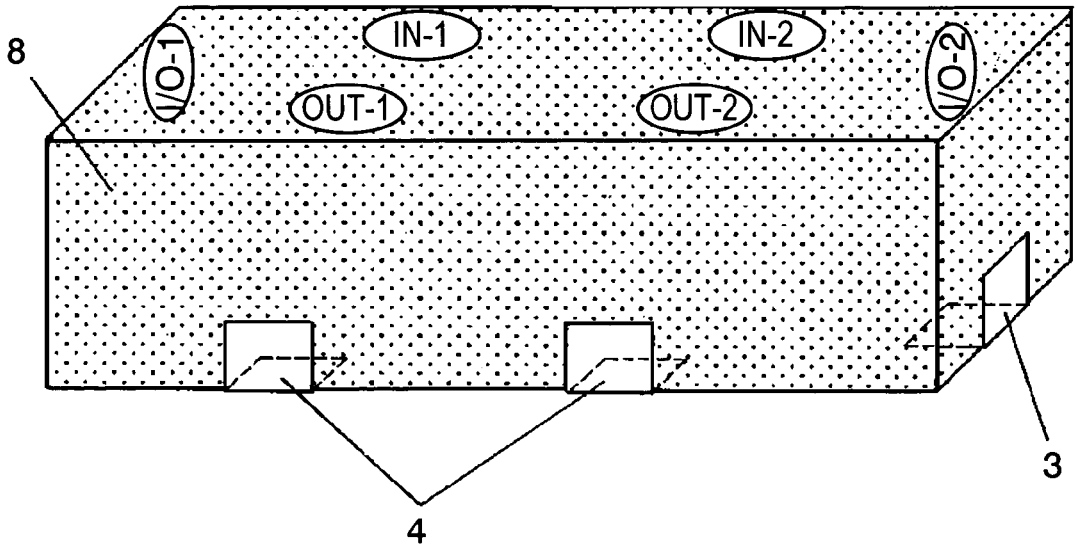
FIG. 7 is an exterior view of the choke coil having the coil disposed such that intermediate tap come out in different directions used in the present invention.

The choke coil used in exemplary embodiment 2 disposes coil 1 incorporated with terminals and intermediate tap such that two intermediate taps 3 and terminals 4 come out in different directions respectively as shown in FIG. 7.

In this context, when terminal 4 and intermediate tap 3 come out from various surfaces of magnetic material 8, terminal 4 and intermediate tap 3 can get a large surface area as a large clearance is produced between terminals and intermediate taps 3. Namely, the choke coil can be available for large current applications as resistances of terminal 4 and intermediate tap 3 can be lowered due to better heat discharge characteristics.

Additionally, the choke coil structure after mounting is strong against forces from various quarters because soldering points of terminals 4 and intermediate taps 3 are shared in four surfaces. The polarity of terminals 4 and intermediate taps 3 can be identified easily after mounting by the marks shown on magnetic material 8.

(Exemplary Embodiment 3)

Next, the choke coil used in exemplary embodiment 3 is described with reference to FIGS. 8A, 8B, 8C and 9. The fundamental structure of the choke coil is similar to the choke coil used in exemplary embodiment 1.

Figure 8A:
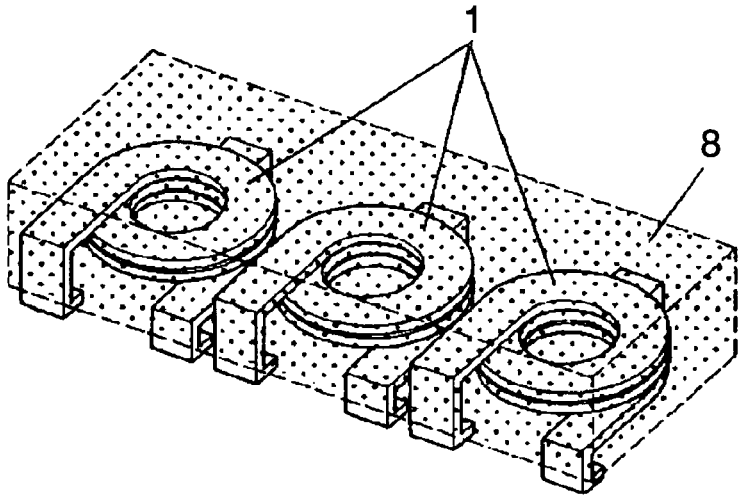
FIG. 8A is a perspective view of the choke coil consisting of the coil incorporated with terminals and intermediate tap used in the present invention.
Figure 8B:
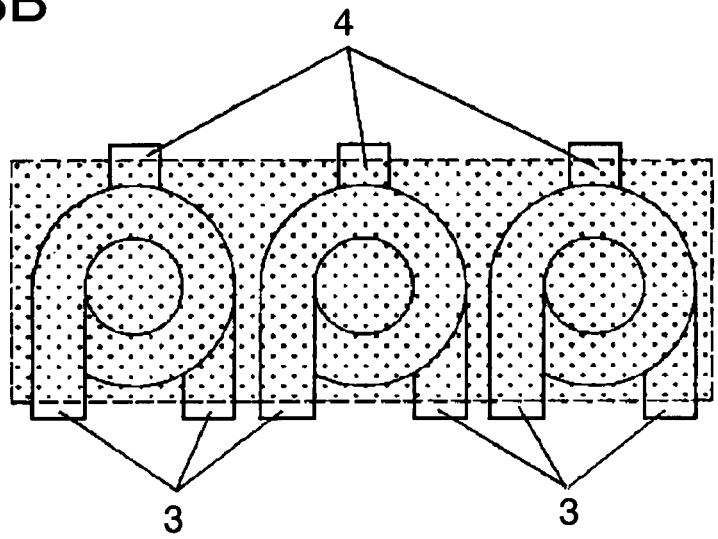
FIG. 8B is a top plan view of the choke coil consisting of the coil incorporated with terminals and intermediate tap used in the present invention.
Figure 8C:
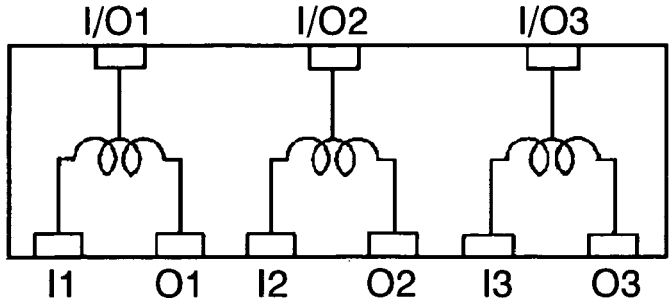
FIG. 8C is a block diagram of the choke coil consisting of the coil incorporated with terminals and intermediate tap used in the present invention.

Three coils 1 incorporated with terminals and intermediate tap are embedded in a square pole shaped magnetic material to form a negative coupling layout as shown in FIGS. 8A, 8B and 8C. Every terminal 4 comes out to a single surface, and every intermediate tap comes out to a surface facing against the surface. FIG. 8A is a perspective view, FIG. 8B is a top plan view and FIG. 8C is a block diagram of a case for the choke coil to connect to a power supply circuit of multi-phase system and transformer system. I1, I2 and I3 denote input terminals, O1, O2 and O3 denote output terminals, and I/O1, I/O2 and I/O3 denote intermediate taps connected to switching elements. Namely, each of three coils 1 incorporated with terminals and intermediate taps included in the structure performs as a transformer respectively and are connected in parallel to be controlled separately in output phases.

As described above, every terminal 4 comes out to a single surface of a square pole shaped magnetic material 8, and every intermediate tap 3 comes out to a surface facing against the surface. The structure can contribute to the practical mounting procedure of the choke coil, because circuit layout of ICs is improved by mounting the choke coil on a printed board or the like The same effect can be expected when every terminal 4 and every intermediate tap 3 come out to a single surface. For example, an idea is to arrange input terminals, intermediate taps 3 and output terminals alternately. Additionally, every terminal 4 and every intermediate tap 3 need not necessarily come out to a single surface, if more than two terminals 4 and/or intermediate taps 3 come out to a single surface, the same effect as described above can be expected on the single surface. In this occasion, parts can be identified easily by the marks shown on magnetic material 8 such as IN for input terminals, OUT for output terminals and IN/OUT for intermediate taps.

Square pole shaped magnetic material 8 in the exemplary embodiment may be provided with round edges to recognize the direction easily or polarity mark may be applied for terminals 4 and intermediate taps 3.

In exemplary embodiment 3, the choke coil is used as a power supply circuit of multi-phase system and transformer system. Of course, the choke coil can be used as an output circuit performing six phases control using all coils connected in parallel, and can be used in various application ways such as series connection or combination of all cases.

(Exemplary Embodiment 4)

Figure 9:
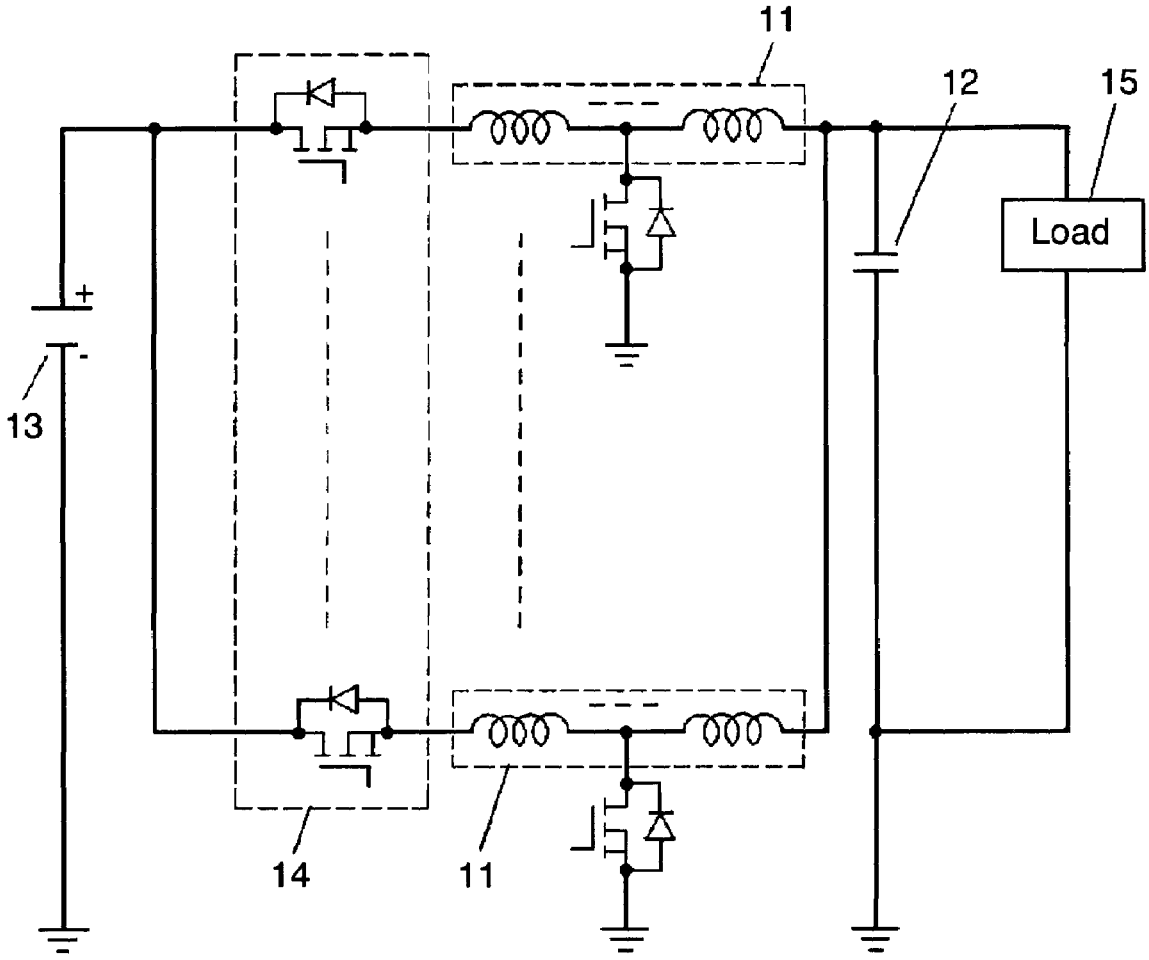
FIG. 9 is a block diagram of the power supply connecting a plurality of DC/DC converters in parallel.

FIG. 9 is a block diagram of a DC/DC converter using the choke coil. The converter comprises: a plurality of choke coils 11, whose one end and intermediate tap are connected to switching elements 14 respectively, disposed in parallel; and capacitance 12 is connected further in series. Input terminals 13 are connected to the converter and load 15 is connected to the output side.

As is clear in FIG. 9, various kinds of combination are possible in number of phases controlled by multi-phase system, or number of coils connected in parallel, position or number of taps according to the input and aiming output.

The choke coil of the present invention can be available for the various circuit configurations flexibly.

Namely, one coil 1 incorporated with terminals and intermediate tap, two coils 1 incorporated with terminals and intermediate tap and three coils 1 incorporated with terminals and intermediate tap are embedded in magnetic material 8 in exemplary embodiment 1, 2 and 3 such that central points of the coils are on a straight-line in a same plane. The number of coil 1 incorporated with terminals and intermediate tap embedded in the magnetic material may be increased to four or five.

Coils can be disposed in other places than places where coils have been on a straight-line in a same plane. For example, coils may be disposed on V-shape in the same plane. As mentioned above, coils 1 incorporated with terminals and intermediate tap can be embedded in the magnetic material densely by disposing a plurality of the coils alternately to produce a compact sized choke coil.

A plurality of coils 1 can be disposed such that respective central axes are on a straight-line. In this case, coil 1 incorporated with terminals and intermediate tap couple more strongly between themselves than in the case disposed in the same plane.

When the coil has a number of turns of an integer +0.5, a downsized and low profile choke coil is provided by stacking the concavity and convexity portions formed at end of top and bottom coil 1 incorporated with terminals and intermediate tap.

In the above combination, a plurality of coil 1 incorporated with terminals and intermediate tap can be disposed such that the central axes are disposed in parallel, and the central point of at least one of coil 1 incorporated with terminals and intermediate tap and the central points of the other coil 1 incorporated with terminals and intermediate tap are disposed at different heights.

In addition, coil 1 incorporated with terminals and intermediate tap of the present invention can provide the same effect regardless of the number of intermediate tap 3. Coils having a same number of intermediate tap 3 may be employed, or combinations of different number of intermediate tap 3 are possible.

Figure 10:
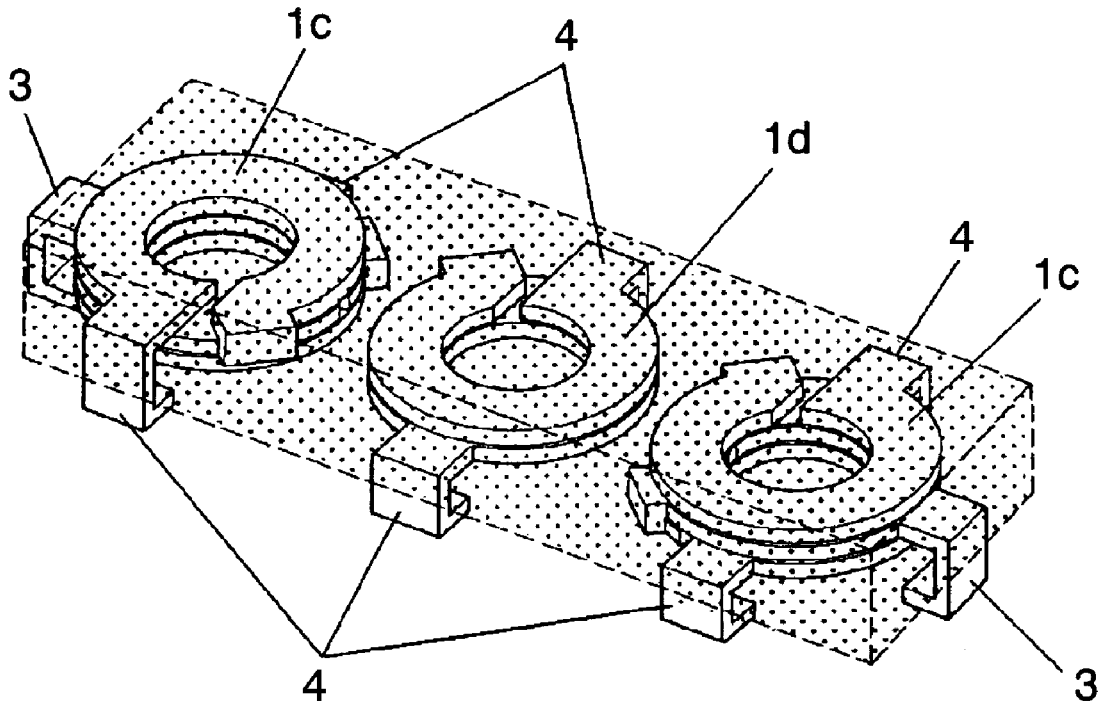
FIG. 10 is a perspective view of the choke coil used in the present invention in which a coil incorporated with terminals and intermediate tap, and a coil incorporated with terminals are housed.

In addition, a combination of a coil incorporated with terminals but no intermediate tap and coil 1 incorporated with terminals and intermediate tap is possible, because the choke coil of the present invention must have at least one coil 1 incorporated with terminals and intermediate tap. FIG. 10 shows a choke coil that includes two coils 1*c* having 2.5 turns and one coil id incorporated with terminals only, having 1.5 turns. Even the choke coil with such structure can provide the same effect to meet the needs for downsizing and availability for high frequency large current applications.

As aforementioned, the present invention can provide the choke coil that performs effectively in various circuitries predicted previously, by adjusting and combining: position of terminals 4; number of turns; number and positions of tap; clearance in case of plurality; and disposition of positive coupling or negative coupling of coil 1 incorporated with terminals and intermediate tap incorporated with terminals and intermediate tap.

As is clear from the above description, the present invention can provide a choke coil that performs effectively in various circuitries predicted previously, because the choke coil comprises a coil incorporated with terminals and intermediate tap manufactured of die cut metal plates and formed by folding and a magnetic material in which the coil is embedded.

What is claimed is:

1. A choke coil, comprising:

a metal plate having a folded portion, a first terminal, and a second terminal; and a magnetic material in which the coils are embedded, with an insulation layer on the surface of the metal plate except the surfaces of the folded portion, the first terminal and the second terminal, wherein the metal plate additionally includes an intermediate tap, and the insulation layer is not on the intermediate tap.

2. The choke coil of claim 1, wherein the metal plate is formed by pressing or etching.

3. The choke coil of claim 1, wherein the magnetic material comprises a material selected from the group consisting of a ferrite magnetic material of; a composite of ferrite magnetic powder and insulating resin; and a composite of magnetic metal powder and an insulating resin.

4. The choke coil of claim 1, wherein at least one of terminals and intermediate tap of the coils are disposed across at least two surfaces among a bottom surface and adjacent surfaces.

5. The choke coil of claim 1, wherein marking of terminals and/or intermediate taps are provided on the magnetic material.

6. The choke coil of claim 1, wherein at least terminals and intermediate taps of the coil exposed to surfaces are provided with Ni as a foundation layer, and with one of solder layer and Sn layer as a surface layer.

7. The choke coil of claim 1, wherein the magnetic material is square pole shaped.

8. The choke coil of claim 1, wherein a coil having an intermediate tap, and a coil having no intermediate tap are embedded in the magnetic material.

9. The choke coil of claim 8, wherein the neighboring two coils are disposed such that the respective magnetic fluxes generated by current flow pass through the coil to opposite directions respectively.

10. The choke coil of claim 8, wherein the neighboring two coils are disposed such that respective magnetic fluxes generated by current flow pass through the coil to a same direction.

11. The choke coil of claim 8, wherein the coils are located such that at least two intermediate taps emerge in different directions.

12. The choke coil of claim 8, wherein the coils are located such that all intermediate taps emerge in a same direction.

13. The choke coil of claim 1, wherein a plurality of coils are embedded in the magnetic material.

14. The choke coil of claim 8, wherein an inductance of a plurality of the coil is incorporated with terminals and intermediate tap, and/or the coil incorporated with terminals are controlled to a predeterminate value by adjusting an interval between the coils.

15. The choke coil of claim 13, wherein an inductance of a plurality of the coil incorporated with the terminals and intermediate tap, and/or the coil incorporated with terminals are controlled to a predeterminate value by adjusting an interval between the coils.

16. The choke coil of claim 13, wherein the neighboring two coils are disposed such that respective magnetic fluxes generated by current flow pass through the coil to opposite directions respectively.

17. The choke coil of claim 13, wherein two adjacent coils are located such that respective magnetic fluxes generated by current flow pass through the two coils in a same direction.

18. The choke coil of claim 13, wherein the coils are located such that all intermediate taps emerge a same direction.

19. The choke coil of claim 13, wherein the coils are located such that at least two intermediate taps emerge in different directions.

* * * * *